US005244778A

United States Patent [19]

Fyson

[11] Patent Number: 5,244,778

[45] Date of Patent: Sep. 14, 1993

[54] THIOSULPHATE FIXING SOLUTIONS

[75] Inventor: John R. Fyson, Hackney, Great Britain

[73] Assignee: Eastman Kodak Company, Rochester, N.Y.

[21] Appl. No.: 915,832

[22] PCT Filed: Jan. 15, 1991

[86] PCT No.: PCT/EP91/00071

§ 371 Date: Jul. 16, 1992

§ 102(e) Date: Jul. 16, 1992

[87] PCT Pub. No.: WO91/10939

PCT Pub. Date: Jul. 25, 1991

[30] Foreign Application Priority Data

Jan. 18, 1990 [GB] United Kingdom ..... 9001145

[51] Int. Cl.[5] ..... B03C 5/38

[52] U.S. Cl. ..... 430/455; 430/393; 430/419; 430/456

[58] Field of Search ..... 430/393, 419, 455, 456, 430/459, 966

[56] References Cited

U.S. PATENT DOCUMENTS

| | | | |
|---|---|---|---|
| 2,397,016 | 7/1944 | King | 430/456 |
| 3,008,828 | 11/1961 | Henn | 430/453 |
| 3,261,685 | 7/1966 | Haer et al. | 430/419 |
| 3,674,490 | 7/1972 | Matejec | 430/376 |

FOREIGN PATENT DOCUMENTS

| | | | |
|---|---|---|---|
| 0207001 | 12/1986 | European Pat. Off. . | |
| 0327273 | 8/1989 | European Pat. Off. . | |
| 390265 | 7/1907 | France . | |
| 60925 | 5/1979 | Japan | 430/455 |
| 90/13060 | 11/1990 | World Int. Prop. O. . | |

OTHER PUBLICATIONS

G. Haist: "Modern Photographic Processing", 1979, John Wiley & Sons, New York, see p. 598, line 29–p. 599, line 13.

Chemical Patents Index, Basic Abstracts Journal Week 8932,20 Sep. 1989, No. 89/233474/32, Derwent Publications Ltd., London, G.B. & SU-A-1456926 (Phys Che Problems) Jul. 2, 1989.

*Primary Examiner*—Hoa Van Le

*Attorney, Agent, or Firm*—Nixon, Hargrave, Devans & Doyle

[57] ABSTRACT

An acid photographic fixing agent adapted for colour photography utilizing silver coating rates of up to 2.1 mg/dm$^2$ whereby stabilized thiosulfate fixer solution has a concentration of less than 10 gpl of ammonium thiosulphate or its chemical equivalent, comprising a solution of an alkali metal thiosulphate or an ammonium thiosulphate or a mixture thereof stabilized by a soluble sulphite or bisulphite; characterized in that the ratio by weight of the soluble sulphite to the thiosulphate is greater than 1.2:1 or greater than 1.44:1 if the bisulphite is used; thereby to preferentially maintain the thiosulfate in use.

6 Claims, No Drawings

THIOSULPHATE FIXING SOLUTIONS

DESCRIPTION

The present invention relates to thiosulphate fixing solutions. The use of thiosulphate as a fixing agent is well known in the photographic art. It is usually combined with a low concentration of a soluble sulphite as a stabilizer.

These traditional high concentration thiosulphate fixers can be used with low coating weight silver photographic materials, but the thiosulphate is not used efficiently, and large concentrations of uncomplexed thiosulphate go to waste and constitute an unnecessary burden on sewage treatment plants as measured by BOD(5), or COD.

The present invention has addressed this problem, particularly with colour photographic materials coated low weights of silver by providing a stabilized thiosulphate fixer solution having concentrations of less than 1/10 of the conventional values (e.g. 100 gpl) and wherein the soluble sulphite stabilizer is in an excess.

U.S. Pat. No. 2,397,016 reveals alkaline fixers having a narrow range of utility in between pH 8.3 and pH 9.0 and utilizing a substantial excess of alkaline metal sulphite as a stabilizer for the thiosulphate. Such fixers cannot operate under acid conditions.

In U.S. Pat. No. 3,008,828 there is dislosed an acid photographic hardner fixer bath comprising a hardening agent, a soluble thiosulphate, such as sodium thiosulphate and/or ammonium thiosulphate; an acid such as acetic acid, and a soluble sulphite or bisulphite such as sodium sulphite and/or sodium bisulphite. The bisulphite has an activity ratio of 2:1 and hence is slightly more effective than the sulphite, however it is acidic and for some fixes it is better to use sulphites as they provide some buffering against changes in acidity.

In this disclosure the alkali metal sulphite is disclosed as being utilized in the bath in an excess by weight of up to twice that of the alkali metal thiosulphate. This improves the wash out characteristics.

We have now found that photographic fixing agents, particularly when utilized with photographic colour materials coated with low rates of silver can be effectively fixed by means of a fixing solution comprising a significant excess of the soluble sulphite material. This has both economic and environmental advantages.

According to the present invention therefore there is provided an acid photographic fixing agent adapted for colour photography utilizing silver coating rates of up to 2.1 mg/dm$^2$ whereby stabilized thiosulfate fixer solution has a concentration of less than 10 gpl of ammonium thiosulphate or its chemical equivalent, comprising a solution of an alkali metal thiosulphate or an ammonium thiosulphate or a mixture thereof stabilized by a soluble sulphite or bisulphite; characterised in that the ratio by weight of the soluble sulphite to the thiosulphate is greater than 1.2:1 or greater than 1.44:1 if the bisulphite is used; thereby to preferentially maintain the thiosulfate in use.

The soluble sulphite is approximately twice as efficacious as the bisulphite and ratios should be considered accordingly.

The soluble sulphite may be selected from an alkaline metal sulphite such as sodium or potassium sulphite and may be present in a weight ratio of 1.2:1 to 2.5 or even 3:1; preferably about 2:1.

The thiosulphate may be utilized in any convenient effective form such as an organic or inorganic thiosulphate salt. Usually sodium or potassium thiosulphate is utilized.

The fixer solution is particularly efficacious for the removal of silver halides from photographic colour materials coated with low weights of silver for example up to 2.1 mg/dm$^2$ and generally operate best at an acid pH of down to pH4.

In particular it has been found that silver chloride and bromide photographic materials (containing up to 5% of iodide) which are coated with a total silver coating weights of up to 2.1 mg/dm$^2$ can be fixed efficiently with a dilute solution of either an alkali metal or ammonium thiosulphate or a mixture of thiosulphates. This is stabilized by the addition of an excess of sulphite in sufficient quantity to overcome oxidation of the sulphite by the air and by carried in components from previous baths. The sulphite is sacrificially destroyed in preference to the usual fixing agent i.e. the thiosulphate. This makes fixers very suitable to follow processes wherein no bleach-fixer step is utilized. Alternatively fixers in accordance with the present invention could follow a bleach used following the development step if it is necessary to remove silver from the image.

The thiosulphate solutions need only be as concentrated as the processing time dictates. For example with the low silver coatings the rate is governed more by the uptake of material and diffusion out of the silver complexes than by the diffusion of the fixing agent thereinto. Thus the concentration of the fixing agent can be reduced.

The invention will now be exemplified in the following example which is included by way of illustration only.

EXAMPLE

A coating of a colour paper, suitable for an "RX" process was made. This coating was of similar construction to the present "all chloride" 2001 paper, with the same dispersion and gel laydowns except that the silver coating weight was reduced to 0.32 mg/dm$^2$ in the red sensitive layer, 0.32 mg/dm$^2$ in the green sensitive layer and 0.43 mg/dm$^2$ in the blue sensitive layer, giving a total silver laydown of 0.65 mg/dm$^2$.

Samples of this coating were swollen in a 25 g/1 potassium carbonate buffer pH 10.1, to simulate a developer. These were then plunged into the following experimental fixer (25° C.) and processed for varying times:

| | |
|---|---|
| sodium thiosulphate | 10 g |
| sodium sulphite (anhydrous) | 20 g |
| water to | 1 liter |
| pH adjusted to 4.9 with acetic acid | |

The strips were then washed for 2 minutes in water and treated with a 5 g/1 sodium sulphide solution to reveal any residual silver chloride as silver sulphide. The samples were then washed for a further 2 minutes, then hung up to dry. The blue reflection density of each strip was measured. It was found that the maximum density for the unfixed sample was 0.55 and for a totally fixed sample, 0.05. Atomic adsorption measurements of the silver showed that there was a good linear correlation between blue reflection density and residual silver.

From the density measurements, it was therefore possible to estimate the residual silver in the paper.

A series of fixers were made up containing between 5 and 20 g/1 sodium thiosulphate and 20 g/1 sulphite. Each fixer was tested using the above technique, with the pH adjusted to 4.9. All samples showed no evidence of residual silver after 10 seconds fixing time, the lowest practical fixing time for the apparatus being used. The experiment was repeated with the pHs adjusted to 6.0 and 8.0. Again no silver could be detected after 10 second fixing.

A sulphite fixer that fixed this coating in 10 seconds would have to contain over 100 g/1 sodium sulphite. This would have a chemical oxygen demand (COD) more than twice that of any of the above thiosulphate fixers and the cost would similarly be twice as high with the present cost of chemicals.

Accordingly the advantages of the above identified fixer are as follows: 1. Compared to an all sulphite fixer with a similar fixing time the oxygen demand is lower. 2. Compared with an all sulphite fixer with a similar fixing time the cost is lower. 3. The fixer is stable to air and to previous processing solutions and is also more stable than a dilute conventional high concentration thiosulphate fixer, with a low thiosulphate/sulphite ratio. 4. Silver recovery is easier than from a bleach-fix. Silver recovery can be carried out using traditional thiosulphate silver recovery methods. 5. The fixers of the present invention can be utilized at modestly acid pHs (down to pH4) which reduces the risk of continued development in the fix as compared to a sulphite fix.

I claim:

1. An acid photographic fixing agent adapted for colour photography utilizing silver coating rates of up to 2.1 mg/dm$^2$ whereby stabilized thiosulfate fixer solution has a concentration of less than 10 gpl of ammonium thiosulphate or its chemical equivalent, comprising a solution of an alkali metal thiosulphate or an ammonium thiosulphate or a mixture thereof stabilized by a soluble sulphite or bisulphite;

characterised in that the ratio by weight of the soluble sulphite to the thiosulphate is greater than 1.2:1 or greater than 1.44:1 if the bisulphite is used; thereby to preferentially maintain the thiosulfate in use.

2. A fixing agent according to claim 1 wherein the alkali metal is sodium or potassium.

3. A fixing agent according to claim 1 wherein the soluble sulphite or bisulphite is an alkali metal or ammonium salt.

4. A fixing agent according to claim 1 wherein the weight ratio of the sulphite to the thiosulphate is 1.2:1 to 2.5:1.

5. A fixing agent according to claim 4 wherein the weight ratio of the sulphite to the thiosulphate is about 2:1.

6. A process for fixing silver halide photographic materials having a total silver coating weight of less than 2.1 mg/dm$^2$ which comprises applying thereto a fixing agent as claimed in claim 1.

* * * * *